US005333695A

United States Patent [19]

Walter

[11] Patent Number: 5,333,695

[45] Date of Patent: Aug. 2, 1994

[54] QUICK CHANGE DEVICE

[75] Inventor: Karl-Heinz Walter, Baden-Baden, Fed. Rep. of Germany

[73] Assignee: Lehnhoff Hartstahl GmbH & Co., Baden-Baden, Fed. Rep. of Germany

[21] Appl. No.: 911,185

[22] Filed: Jul. 9, 1992

[30] Foreign Application Priority Data

May 8, 1992 [DE] Fed. Rep. of Germany ..... 4214569

[51] Int. Cl.[5] ..... A01B 51/00; B25G 3/00; B60C 23/00

[52] U.S. Cl. ..... 172/272; 403/327; 403/326; 414/723; 414/703; 172/443

[58] Field of Search ..... 172/272, 443; 403/327, 403/326, 325, 321; 37/231; 414/723, 703

[56] References Cited

U.S. PATENT DOCUMENTS

| | | | |
|---|---|---|---|
| 3,498,638 | 3/1970 | Magruder | 172/272 |
| 3,760,883 | 9/1973 | Birk | 414/723 |
| 3,818,551 | 6/1974 | Coughran, Jr. | 172/272 |
| 4,085,856 | 4/1978 | Westendorf . | |
| 4,345,872 | 8/1982 | Arnold | 414/723 |
| 4,549,744 | 10/1985 | Herr et al. | 172/272 |
| 4,810,162 | 3/1989 | Foster | 414/723 |
| 4,984,958 | 1/1991 | Kaczmarczyk | 414/723 |
| 5,082,389 | 1/1992 | Balemi . | |

FOREIGN PATENT DOCUMENTS

| | | | |
|---|---|---|---|
| 374526 | 5/1984 | Australia . | |
| 389906 | 2/1990 | Australia . | |
| 0270504 | 6/1988 | European Pat. Off. . | |
| 0273828 | 10/1990 | European Pat. Off. . | |
| 1784323 | 8/1971 | Fed. Rep. of Germany . | |
| 3312442 | 2/1984 | Fed. Rep. of Germany | 414/723 |
| 3838411 | 5/1990 | Fed. Rep. of Germany . | |
| 2670520 | 6/1992 | France . | |
| 1563606 | 5/1990 | U.S.S.R. | 172/272 |

*Primary Examiner*—Clifford D. Crowder
*Assistant Examiner*—Bibhu Mohanty
*Attorney, Agent, or Firm*—Eugene Stephens

[57] ABSTRACT

A quick change device for earth moving vehicles for changing working implements and separably connected to the vehicle via an adaptor pivotable about a horizontal axis and provided on a jib of the earth moving machine, the adaptor having displaceably mounted coupling members rigid with the housing and with which there are on the working implements coupling members rigid with the housing, the displaceably mounted coupling members of the adaptor being locking bolts which have conical coupling surfaces and with which there are associated on the working implement coupling members which have conical surfaces and which are constructed in supporting fashion only over a range of 180° with the corresponding conical surfaces of the associated coupling members of the working implement which are rigid with the housing.

7 Claims, 3 Drawing Sheets

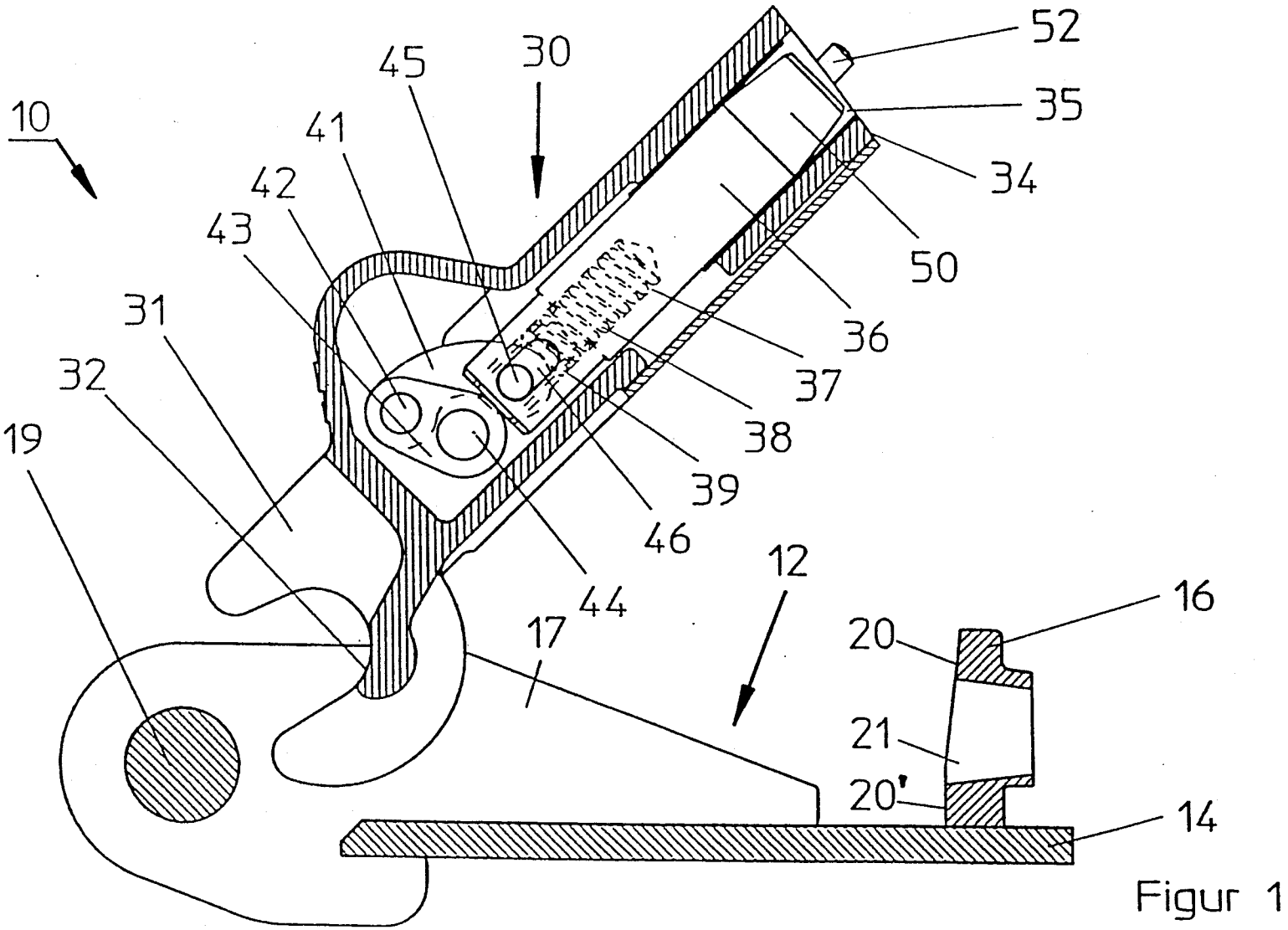
Figur 1

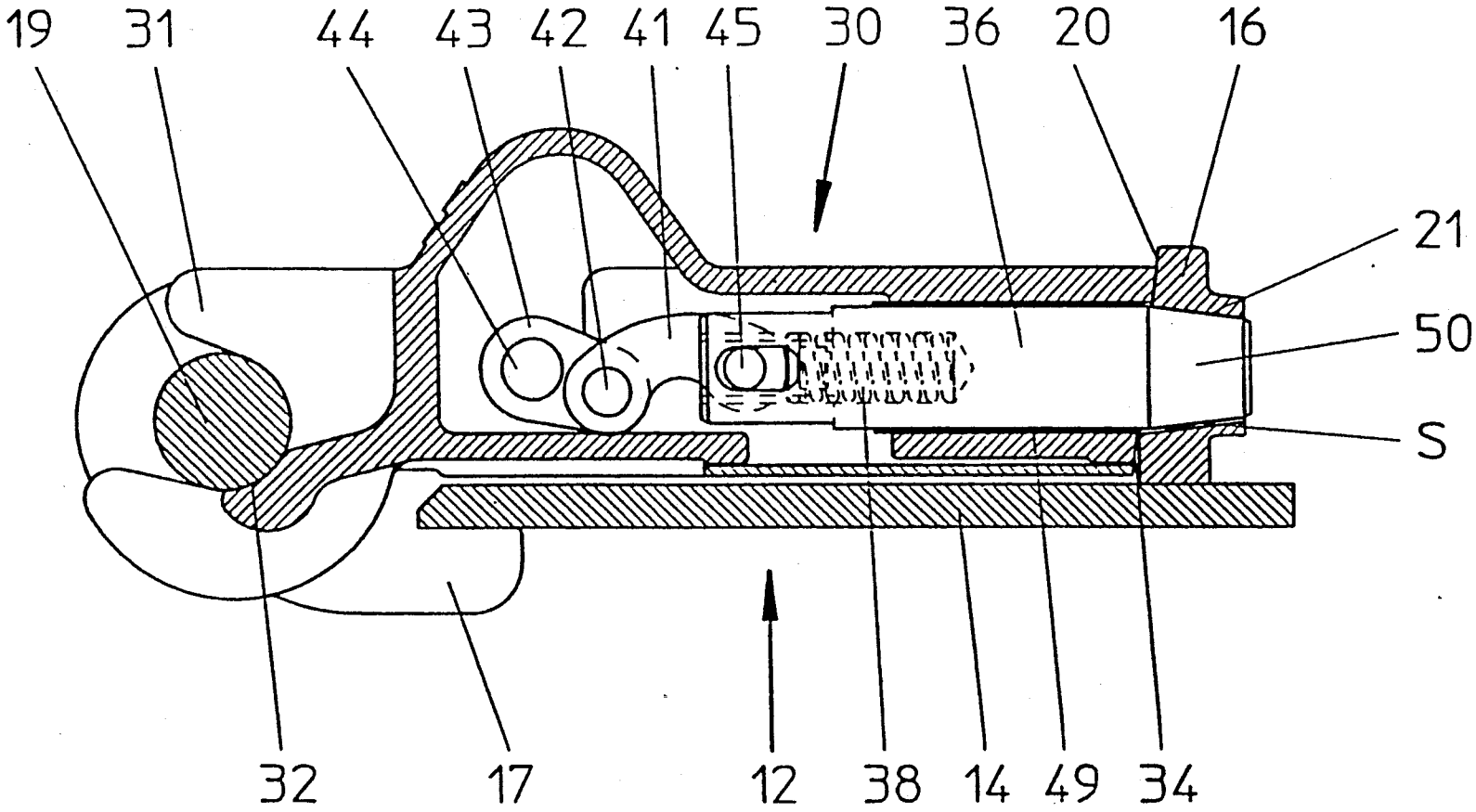
Figur 2

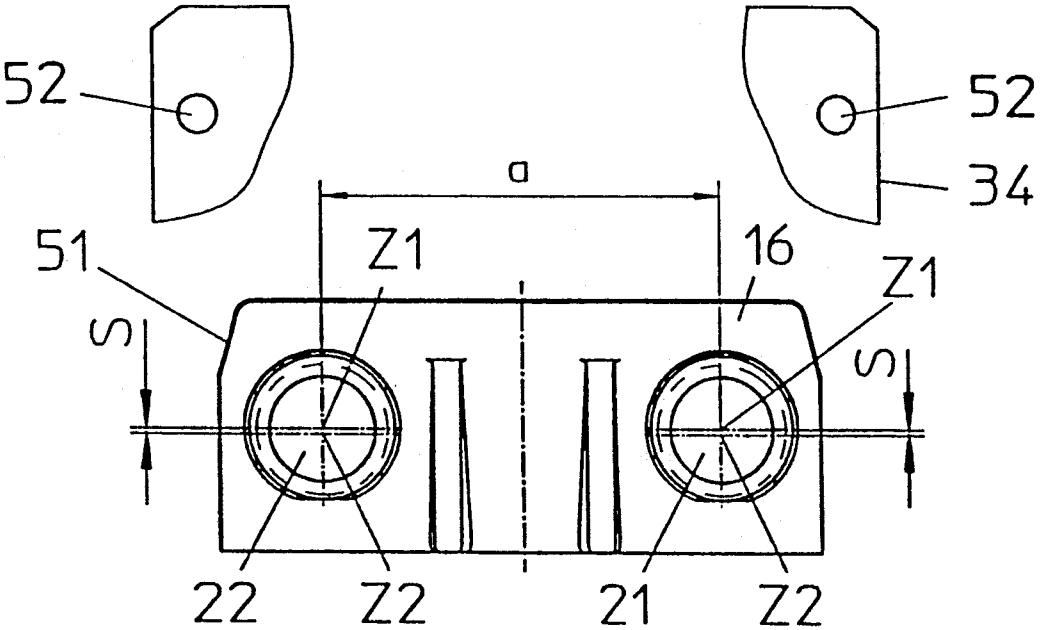
Figur 3

QUICK CHANGE DEVICE

FIELD OF THE INVENTION

The invention relates to a quick change device for earth moving vehicles for changing working implements which are separably connected to the vehicle by means of an adaptor capable of pivoting about a horizontal axis on a jib of the earth moving machine and comprising displaceably mounted coupling members rigid with the housing and associated with which there are on the working implement coupling members rigid with the housing.

BACKGROUND OF THE INVENTION

In the case of a prior art construction of such a quick change device the coupling members rigid with the housing comprise a coupling spindle on the working implement and engaging partially around this there are holding claws on the jib, the displaceably mounted coupling member being a spring loaded wedge which co-operates like a hook with the fixed coupling member disposed on the working implement, the wedge being capable of being locked outside the operative position by a locking device which is released during the process of coupling between jib and working implement so that for locking purposes the wedge becomes inserted under the hook due to the action of the spring; see AT-B 389 906.

It is also known for the displaceable coupling members to be constructed as locking bolts adapted for insertion via a lever arrangement into associated bores in a carrier plate on the working implement; see DE-A 17 84 323.

Finally, quick change devices are known in which the movable coupling members provided are spring loaded detents which,; in the coupling condition, engage over a matching bolt part and which are capable of being released by the application of an external force to oppose the spring force; see DE-A 33 12 442.

Common to all the previously known quick change devices are their complicated construction and susceptibility to breakdown, having regard to the severe conditions of use in earth moving work, so that the aim with such quick change devices, which is that the driver of the earth moving vehicle should be able to change over working implements without the help of further personnel, is unattainable.

On the other hand, however, there is a considerable need for easily operated quick change devices which function reliably for long working periods.

On a basis of the quick change device mentioned at the outset, the invention is based on the problem of providing a universally usable space-saving quick change device which, while having just a few component parts which in spite of the inevitable wear and tear will operate reliably over long periods, makes it possible for the driver alone securely to fit and interlock a working implement and jib on an earth moving machine.

SUMMARY OF THE INVENTION

According to the invention, this problem is resolved in that the coupling members of the adaptor which are rigid with the housing are constructed as abutment surfaces which face away from each other and of which one abutment surface is of cylindrical construction, being bounded on both sides by holding claws which engage at least partially around the coupling member on the working implement, the said coupling member being rigid with the housing, constructed as a coupling spindle and mounted on an adaptor plate, the cylindrical abutment face being supported on the outside surface of the working implement coupling member, while the other abutment face is of plane construction and is disposed at an angle to an imaginary plane passing through both abutment faces and in that the abutment face has apertures through which displaceable coupling members can pass and in that there are associated with the displaceable coupling members other coupling members rigid with the housing of the working implement and which have coupling faces corresponding to coupling faces on the displaceable coupling members, being disposed in a locking bolt plate having a surface which is towards the flat abutment face of the adaptor and which is constructed to co-operate correspondingly therewith.

According to a further feature of the invention, the coupling and bolt surfaces of the displaceably mounted and housing-rigid coupling members are so constructed and disposed that they form a wedge arrangement which clamps the adaptor housing and the adaptor plate to each other.

Furthermore, in accordance with the invention, the peripheral surfaces of the displaceable and of the associated housing-rigid coupling members and which act as coupling members themselves are constructed as conical surfaces which correspond to one another over a peripheral angle of about 180° while at least the partial peripheral surfaces which, on the coupling members associated with the working implement, make up the peripheral surface to 360° are constructed with a predetermined clearance while being associated with the portions of the peripheral surfaces of the displaceable coupling members.

Further features of the invention will emerge from the sub-claims.

Construction of the components of the quick change device which are used for clamping and locking in the manner proposed by the invention has the advantage that during the locking process the locking bolts exert a supporting function solely in the upper half of the shell of the frustoconical portion while the sloping clamping surface of the adaptor housing has its full area sliding on the sloping clamping surface as the locking plate so that a clamping process is carried out at the same time directly the locking process is initiated.

During the coupling process, the adaptor housing is pressed forwards against the coupling spindle and the preferably elliptically constructed clear space between locking bolt and apertures in the locking plate guarantees that the locking bolts are being constantly urged forwards, and are therefore free to move into the locking position. The locking bolts which are subject to spring tension therefore assume a low tension function, a surface pressure being created between the aforementioned sloping surfaces by the fact that the holding claws bear on the coupling spindle.

Should tolerances occur as the result of wear and tear, they are cancelled out in that the spring loaded locking bolts can be advanced farther into the clearance afforded by the apertures in the locking plate.

By means of the centring members, it is possible to achieve a pre-centring when lowering the adaptor housing onto the adaptor plate associated with the working implement, so that the locking work is facilitated and wear and tear due to tilting between the adaptor housing and the working implement is substantially reduced.

The selector shaft of the locking device can be driven either mechanically or hydraulically, the mechanical embodiment comprising a knee lever mechanism in which locking takes place via the dead centre position while the hydraulic embodiment has the locking bolts articulated via a hydraulic cylinder and a self-aligning pressure equalizing bridge.

DRAWINGS

The invention is explained in greater detail hereinafter with reference to an example of embodiment shown in the accompanying drawings, in which:

FIG. 1 shows a cross-section through the quick change device associated partly with the jib of an earth moving machine and partly with the working implement, prior to mutual engagement;

FIG. 2 shows the quick change device according to FIG. 1 in engagement, and FIG. 3 is a right side view of a detail of the quick change device of FIG. 1.

DETAILED DESCRIPTION

A quick change device generally designated 10 in FIG. 1 comprises an adaptor consisting of an adaptor housing 30 and an adaptor plate 12, of which the housing 30 is associated with a Jib arm not shown here but part of a likewise not shown earth moving machine while the adaptor plate 12 is associated with the working implement, like-wise not shown, and to which it is therefore rigidly connected.

The adaptor plate 12 comprises a base plate 14, to one end of which a bolt plate 16 is welded while to the remote end a coupling spindle 19 is welded by means of fixing plates 17. The locking plate 16 has on the side which is towards the coupling spindle a clamping surface 20 which is inclined by 3° to 35° and preferably by 5° to 15° to the vertical surface 20'. Furthermore, as can be seen particularly from FIG. 3, the locking plate 16 is provided with two cross-sectionally conically constructed apertures 21 and 22 which are disposed at a distance a from each other. The cone angle of the apertures defined by conical surfaces is of corresponding dimensions and in the example illustrated amounts to 5° to 15°.

These conical surfaces of the apertures 21 and 22, which comprise 360°, are in each case equidistantly associated with two centres Z1 and Z2, so that in each case two partial conical surfaces are provided, of which the lower partial conical surface in FIG. 1, compared with the imaginary partial conical surface which supplements the upper partial conical surface to provide a complete truncated cone, comprises a clearance S which still has to be described.

The substantially parallelepiped adaptor housing 30 has on each of its side faces a holding claw 31, which in the retracted condition—see FIG. 2—engage around the coupling spindle 19. The end face of the housing 30 which is disposed between the holding claws 31 merges into a cylindrical shell-like abutment surface 32 which—as FIG. 2 also shows—is in the retracted state braced against the cylindrical surface of the coupling spindle 19.

The remotely facing end surface 34 is inclined by 3° to 35° and preferably by 5° to 15° in respect of the vertical—corresponding to the clamping surface 20 of the looking plate 16—and likewise comprises two apertures 35 through which locking bolts 36 mounted for longitudinal displacement in the housing 30 are able to pass.

Each locking bolt 36 has, disposed in a blind bore 37, a spring 38 the free end of which is biased on a spring plate 39 with which the end face of an angled lever 41 is associated. By means of a connecting pin 42, the angled lever 41 is articulated on a switching cam 43 which is rigidly connected to a selector shaft 44. A connecting pin 45 which engages through an elongated hole 46 on the facing end of the locking bolt 36 artlculatingly connects the facing arm of the angled lever 41 to the locking bolt 36.

The aforedescribed parts form a per se known knee or toggle lever mechanism which, driven by the selector shaft 44, upon movement from the inoperative position shown in FIG. 1 into the working position shown in FIG. 2 is moved beyond the dead centre position—imaginary connecting line between the centre points of selector shaft 44 and connecting pin 45—and is therefore blocked. In this way, an automatic release of the extended locking bolts 36 from the locked position shown in FIG. 2 is prevented.

The remote ends 50 of the locking bolts 36 are frustoconical and are constructed with a cone angle of 5° to 15° and correspond to the apertures 21, 22 in the locking plate 16, as can likewise be seen clearly from FIG. 2.

For the purpose of pre-centring during lowering of the adaptor housing 30 onto the adaptor plate 12 of the working implement, centering members are provided of which the centring members associated with the adaptor housing 30 are constructed as cylindrical rods 52 (FIG. 1) which lie in the plane end face 34 on both sides of the displaceable locking bolts 36. The centring members associated with the locking plate 16 are sloping surfaces 51 located in the lowering path of the adaptor housing 30 (FIG. 3). While the adaptor housing 30 is being lowered onto the adaptor plate 12—see FIG. 1—as a result of the sloping surfaces 51, the adaptor housing and therefore the displaceable locking bolts 36 are aligned in relation to the apertures 21, 22 and are thus centred so that the process of coupling between locking bolts 36 and apertures 21, 22 takes place without problem.

By reason of the eccentricity—clearance S—the (with reference to FIGS. 1 to 3) lower partial conical surfaces of the apertures 21, 22 of the locking plate 16, in the engaged position according to FIG. 2, the frustoconical end portions 50 of the locking bolts 36 bear only on the upper partial conical surfaces of the apertures 21, 22, in other words over about 180° of the peripheral surface while the partial conical surfaces of the lower portions are not applied but are free, as is indicated by the gap S in FIG. 2. For this reason, the planes associated with the centres Z1—see FIG. 3—are so aligned that they intersect the connecting pins 45 of the locking bolts 36 centrally and the locking bolts 36 are guided parallel in the adaptor housing 30 by means of correspondingly dimensioned plain bearings 49.

In this engaged position in which the adaptor housing 30 is between the abutment face 32 which bears on the coupling spindle 19 and the clamping surface 20 of the locking plate 16 which bears on the end face 34 of the adaptor housing, the locking bolts 36 clamp the adaptor housing 30 on the adaptor plate 12 as a result of the partial conical surfaces which act as a wedge transmission during movement of the locking bolts 36 out of the inoperative position shown in FIG. 1 into the effective position shown in FIG. 2, and form the second loadtransmitting bearing point of the quick change device which is opposite the coupling spindle 19 which forms the first bearing point and which is enclosed by the holding claws 31.

It goes without saying that also other geometrical forms of clamping faces and locking faces are possible without thereby departing from the idea underlying the invention; for example, instead of conical surfaces, also plane sloping surfaces are possible for the movable locking members and for their associated coupling members which are rigid with the housing. All that is important is that there should be sufficient clearance S between the coupling members affected and those which constitute the wedge-like transmission.

I claim:

1. A quick change device for changing working implements separably connectable to an earth moving machine by means of an adaptor housing mounted on a jib of the earth moving machine to be releasably coupled with an adaptor plate arranged on each working implement, said quick change device comprising:

a. coupling surfaces rigidly arranged on the adaptor housing and the adaptor plate being formed as spaced apart and oppositely confronting;

b. a cylindrical pair of the coupling surfaces being formed by a coupling spindle rigidly arranged on the adaptor plate and a cylindrically shaped abutment surface rigidly arranged on the adaptor housing;

c. the cylindrically shaped abutment surface on the adaptor housing being arranged between a pair of holding claws, and the coupling spindle on the adaptor plate being disposed so that the holding claws can engage at least partially around the coupling spindle on the adaptor plate so that the cylindrically shaped abutment surface on the adaptor housing can engage an outside surface of the coupling spindle on the adaptor plate;

d. a plane pair of the coupling surfaces having flat faces disposed at an angle to an imaginary plane passing through both pairs of coupling surfaces;

e. the adaptor housing containing movable locking bolts disposed to be movable through apertures in the plane coupling surface of the adaptor housing; and f. the plane coupling surface of the adaptor plate being formed on a locking bolt plate having a pair of apertures disposable in registry with the apertures in the adaptor housing for receiving the locking bolts when the plane coupling surfaces of the adaptor housing and the adaptor plate are juxtaposed.

2. The quick change device of claim 1 wherein the ends of the locking bolts received in the apertures of the locking bolt plate are configured to form a wedge engagement with the locking bolt plate for clamping the adaptor housing and the adaptor plate against one another.

3. The quick change device of claim 2 wherein the wedge engagement of the locking bolts and the apertures in the locking bolt plate occurs around one-half of a pair of mating surfaces, and a predetermined clearance is formed around the other half of the mating surfaces.

4. The quick change device of claim 3 wherein the mating surfaces of the locking bolts are conical, and the apertures in the locking bolt plate are half conical surfaces disposed around two centers spaced apart by the predetermined clearance.

5. The quick change device of claim 4 including bearing sleeves in the adaptor housing for guiding the locking bolts, an overcenter knee lever linkage for moving the locking bolts, and thrust springs interposed between the linkage and the lock bolts.

6. The quick change device of claim 4 wherein the plane pair of coupling surfaces are inclined at 3° to 35°, and preferably at 5° to 15°, relative to a surface perpendicular to the adaptor plate.

7. The quick change device of claim 4 including centering members formed as cylindrical rods on the adaptor housing and sloping surfaces on the adaptor plate for guiding the adaptor housing into registered engagement with the adaptor plate.

* * * * *